US005806338A

United States Patent [19]

Schwartz et al.

[11] Patent Number: 5,806,338

[45] **Date of Patent: *Sep. 15, 1998**

[54] COOLING INSERT HAVING MAXIUM HEAT TRANSFER

[76] Inventors: James A. Schwartz; Sue A. McDowell, both of 1705 Indian Rocks Rd., Belleair, Fla. 34616

[ * ] Notice: The term of this patent shall not extend beyond the expiration date of Pat. No. 5,522,239.

[21] Appl. No.: 823,146

[22] Filed: Mar. 25, 1997

[51] Int. Cl.[6] ..... F25D 3/08

[52] U.S. Cl. ..... 62/530; 62/457.5

[58] Field of Search ..... 62/457.2, 457.4, 62/457.5, 457.6, 530, 371

[56] References Cited

U.S. PATENT DOCUMENTS

| | | | |
|---|---|---|---|
| 2,805,554 | 9/1957 | Schachtsiek | 62/457.3 |
| 4,441,336 | 4/1984 | Cannon | 62/457.5 |
| 4,656,840 | 4/1987 | Loofbourrow et al. | 62/530 |
| 5,024,067 | 6/1991 | Maier | 62/457.4 |
| 5,522,239 | 6/1996 | Schwartz et al. | 62/457.5 |

FOREIGN PATENT DOCUMENTS

| | | | |
|---|---|---|---|
| 93/24797 | 12/1993 | WIPO | 62/530 |

*Primary Examiner*—William Doerrler
*Attorney, Agent, or Firm*—Ronald E. Smith

[57] ABSTRACT

A pair of cooler inserts may be used as single units when immersed in a beverage in a container or as a pair when positioned in a cooler of the type designed to hold multi-pack beverage containers. Each insert has a flat top wall, a flat bottom wall, a pair of sidewalls and a pair of flat end walls. Plural concavities are formed in each side wall to accommodate cylindrical surfaces of beverage cans when the inserts are used as a pair to cool multi-pack beverage containers. Posts are formed in the top wall of each insert and post-receiving recesses are formed in the bottom wall of each insert so that a pair of inserts are easily interlocked to one another when a first insert is positioned in overlying relation to a second insert. The flat top and bottom walls ensure that the concavities abut the respective cylindrical surfaces of the multi-pack beverage cans along the entire vertical extent of the cans so that the cans are cooled to the maximum extent possible.

4 Claims, 5 Drawing Sheets

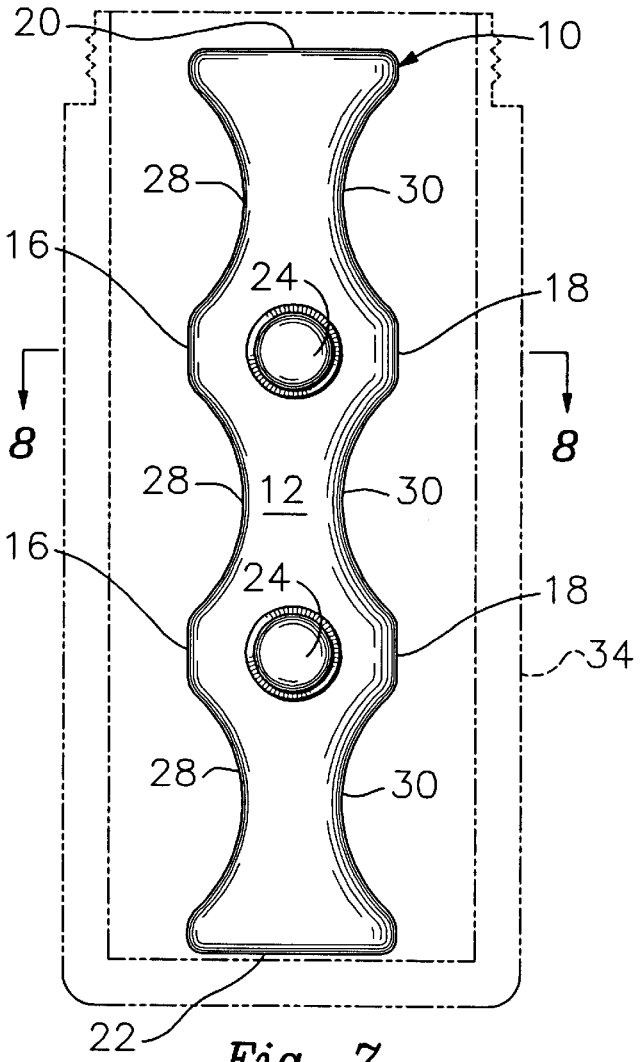
Fig. 7
Fig. 8
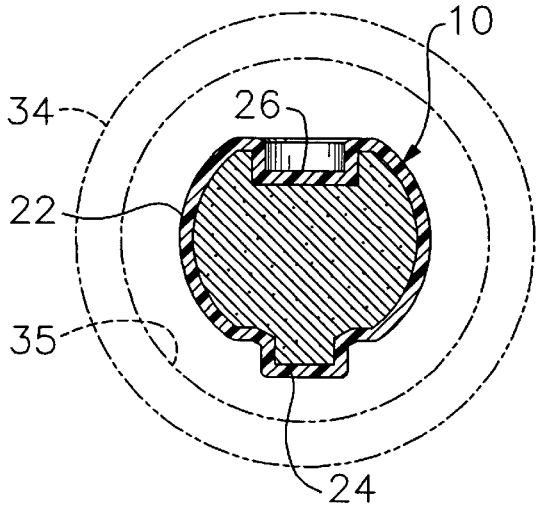

COOLING INSERT HAVING MAXIUM HEAT TRANSFER

BACKGROUND OF THE INVENTION

1. Field of the Invention

This invention relates, generally, to cooling inserts of the type used to cool beverages. More particularly, it relates to a cooling insert that may be used as a single unit immersed in beverage in a beverage container or as a pair of stacked units positioned in a cooler for beverages that are sold in six or other multi-unit packs.

2. Description of the Prior Art

The closest prior art to the present invention is believed to be disclosed in U.S. Pat. No. 5,522,239 to the present inventor. That invention includes a pair of cooling inserts having enlarged ends. Each end has opposed convex surfaces and opposed concave surfaces so that a convex surface is nested within a concave surface when the inserts are stacked in vertical relation to one another. The convex/concave interface provides an interlocking means that maintains the inserts in their stacked relation to one another.

The earlier device performs its intended function. However, the enlarged ends position the respective intermediate parts of the inserts in vertically spaced apart relation to one another, thereby creating a gap where the cans being cooled by the inserts are not contacted by such inserts. Therefore, more efficient cooling could be achieved if that gap could be eliminated, i.e., eliminating the gap would increase the heat transfer between the beverage within the cans and the cooling inserts.

However, in view of the art at the time the present invention was made, it was not obvious to those of ordinary skill in such art that the gap should be eliminated nor was it obvious how such gap could be eliminated while maintaining the interconnection of the stacked inserts.

SUMMARY OF THE INVENTION

The longstanding but heretofore unfulfilled need for an apparatus that overcomes the limitations of the prior art is now met by a new, useful, and nonobvious invention.

The present invention is a device for keeping beverages cool. It includes a first insert of hollow, elongate construction that has a longitudinal extent substantially equal to the longitudinal extent of a six-pack or other multi-unit pack type of beverage container.

The first insert has a flat top wall, a flat bottom wall, a pair of side walls, and a pair of flat end walls.

A first engagement means is formed in the top wall and a second engagement means is formed in the bottom wall. The first and second engagement means have a preselected complementary structure so that the first and second engagement means would engage one another if the flat top wall of the first insert were positioned in underlying relation to a flat bottom wall of a second insert of similar construction or if the flat bottom wall of the first insert were placed in overlying relation to a flat top wall of the second insert.

Both of the sidewalls have a plurality of concavities formed in them, and each concavity is adapted to receive the cylindrical surface of a beverage can.

The side walls and the end walls of the novel insert have a common height so that when a pair of inserts are stacked in vertical relation to one another, the side walls collectively form a solid vertically and longitudinally extending wall so that beverage cans abutting the respective concavities formed in the respective side walls are contacted by the side walls along their entire vertical extent.

A beverage in a beverage container is efficiently cooled by inserting a single insert into the container, i.e., with the single insert immersed in the beverage contained within the container.

A beverage in a six pack-type beverage container is cooled by placing two of the novel inserts in vertically stacked relation to one another into a beverage cooler of the type large enough to hold a six pack (or other number) of beverage containers and by thereafter introducing the pack into the cooler so that half of the beverage containers are positioned on a first side of the novel stacked inserts and half of the beverage containers are positioned on a second side of the novel stacked inserts.

Whether used alone or with a duplicate, the novel insert has a removable cap formed in one of its end walls for introduction of water or other suitable freezable mixture such as a nontoxic freezable gel into the hollow interior of the insert. The insert is placed into a freezer to freeze the gel or mixture therewithin prior to immersion of the insert into a beverage contained within a beverage container or prior to insertion of two of said inserts in stacked relation to one another into a cooler that accommodates multi pack-type beverage cans.

It is therefore understood that a primary object of this invention is to provide an improved cooler insert that cools the entire vertical extent of a beverage can with which it is in contact.

Another object is to provide a cooler insert that can stand alone so that it can be immersed in a beverage contained within a beverage container.

Still another object is to provide a cooler insert that is vertically stackable and interlockable with another cooler insert of the same structure.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 7 is a side elevational view of a novel insert positioned within a beverage container in immersed relation to a beverage; and FIG. 8 is a sectional view taken along line 8—8 in FIG. 7.

DETAILED DESCRIPTION OF THE PREFERRED EMBODIMENT

Figure 1:
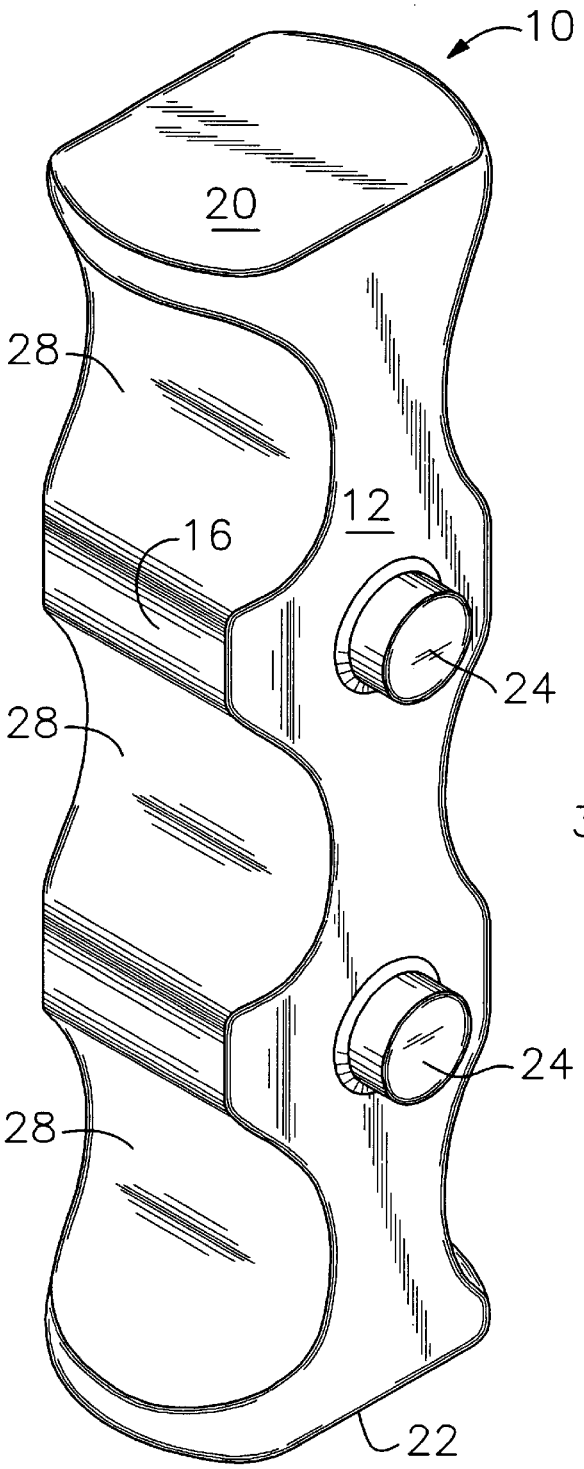
FIG. 1 is a top perspective view of the novel insert.
Figure 2:
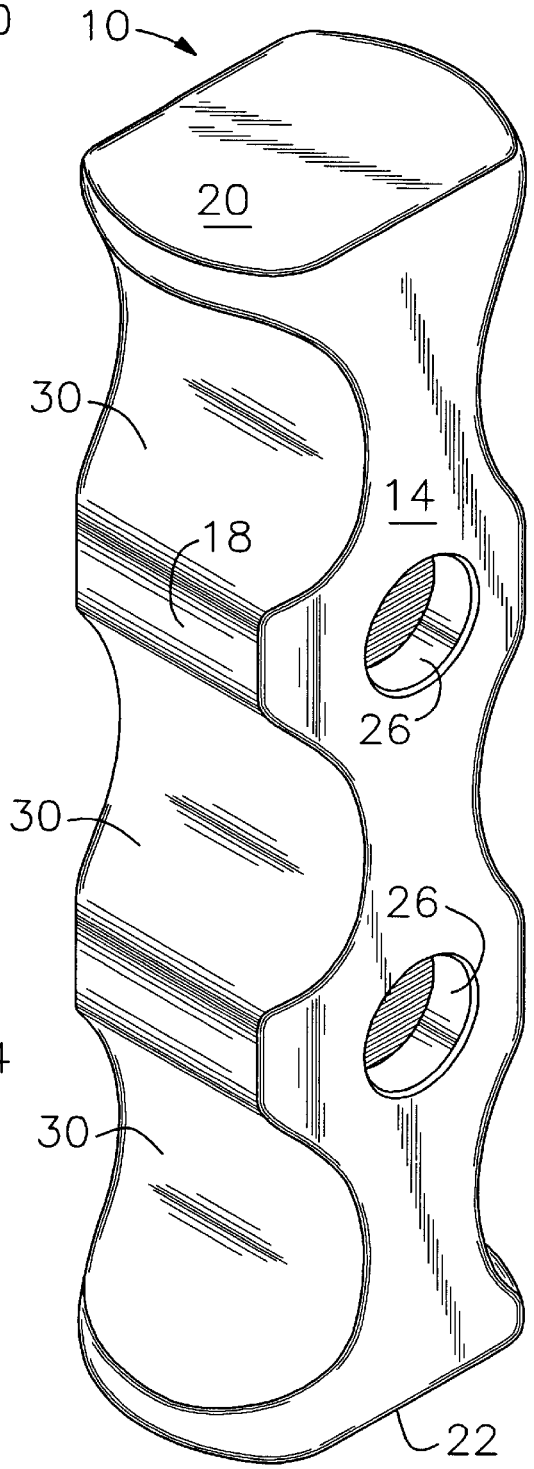
FIG. 2 is a bottom perspective view thereof.
Figure 3:
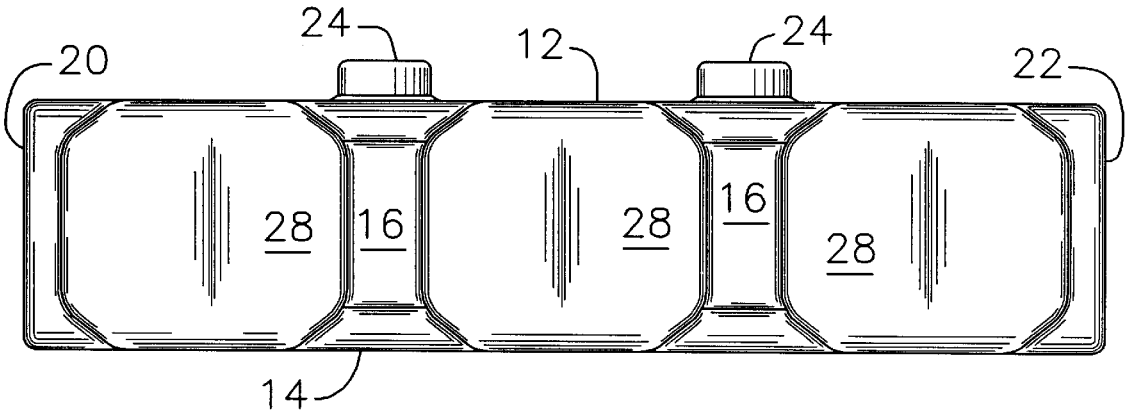
FIG. 3 is a side elevational view thereof.
Figure 4:
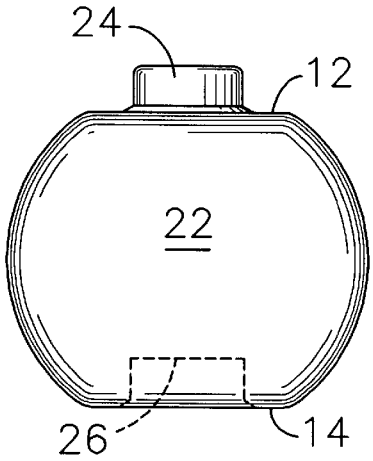
FIG. 4 is an end view thereof.

Referring now to FIGS. 1–4, it will there be seen that an exemplary embodiment of the invention is denoted as a whole by the reference numeral 10.

First insert 10 is of hollow, elongate construction. It includes a flat top wall 12, a flat bottom wall 14, opposed side walls 16, 18, and flat end walls 20, 22.

A pair of longitudinally spaced apart engagement means, collectively denoted 24, are formed in flat top wall 12, and a complementary pair of engagement means, collectively denoted 26, are formed in flat bottom wall 14.

Figure 5:
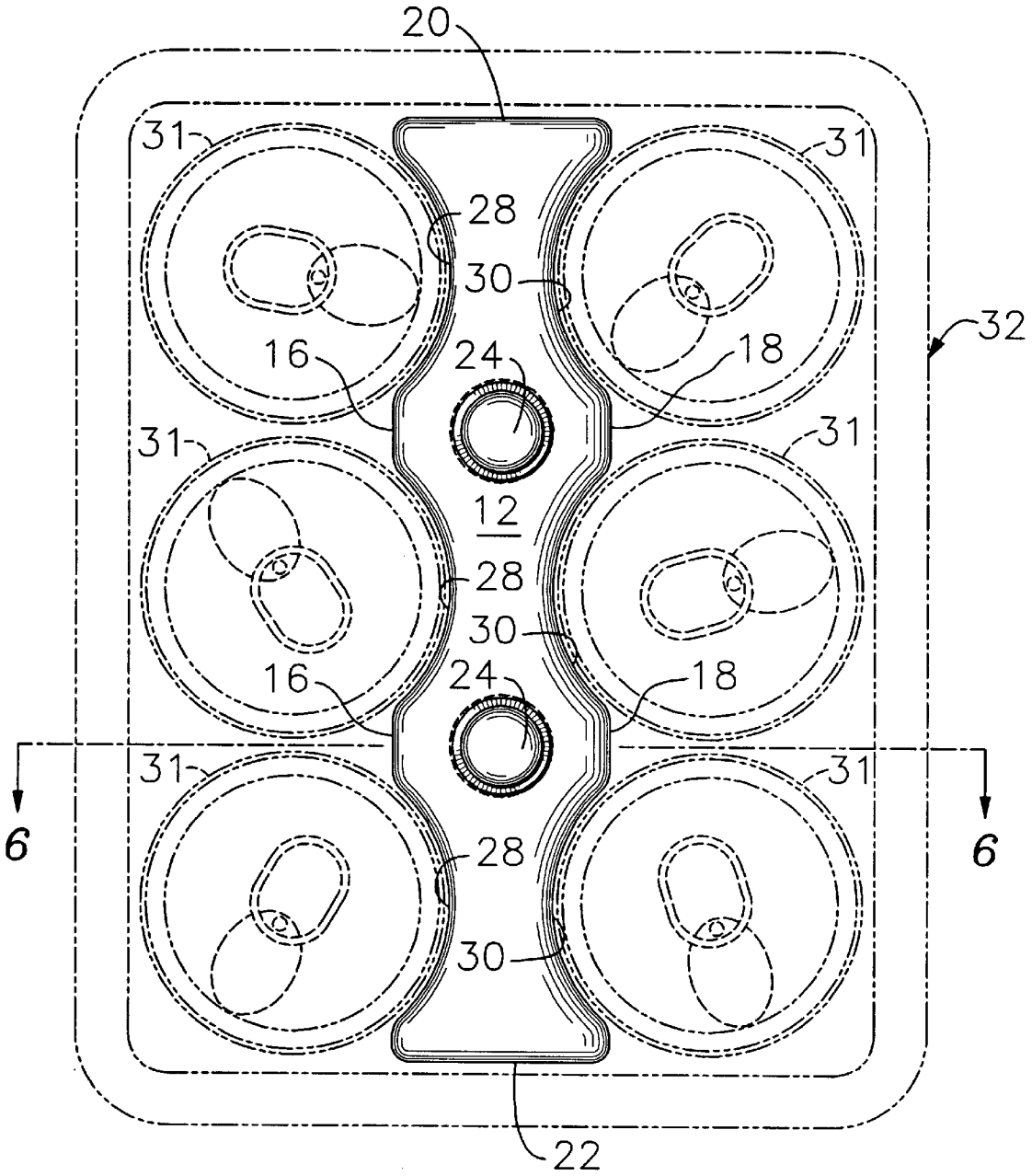
FIG. 5 is a plan view of a cooler having a six pack of beverages and a pair of stacked inserts therein.
Figure 6:
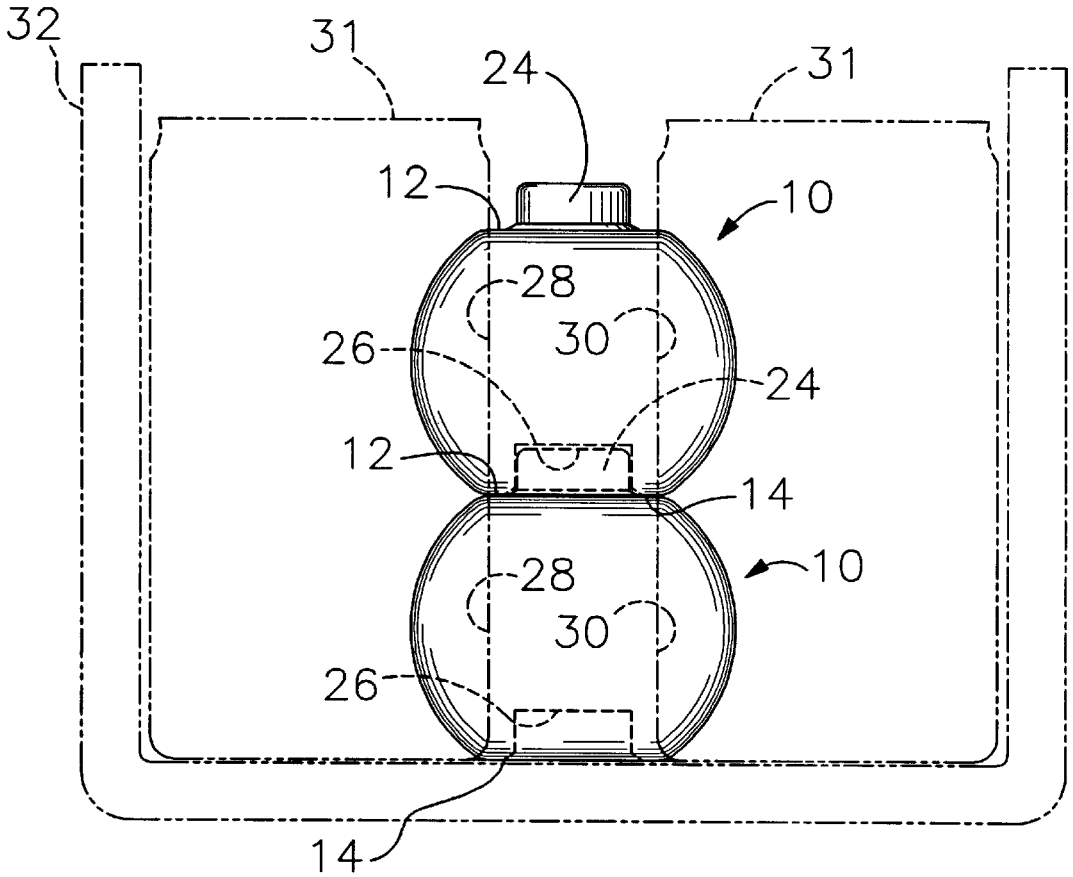
FIG. 6 is a sectional view taken along line 6—6 in FIG. 5.

As best understood in connection with FIGS. 5 and 6, if a second insert having the same construction as first insert 10 is provided and placed into overlying relation to first insert 10, engagement means 24 of the first insert engages engagement means 26 of the second insert due to the flat structure of top and bottom walls 12 and 14.

A first plurality of concavities, collectively denoted 28, are formed in side wall 16 and a second plurality of concavities, collectively denoted 30, are formed in side wall 18. Side walls 16 and 18 have a common height, and end walls 20, 22 share said common height. Accordingly, if said second insert, having the same structure as first insert 10, is stacked in vertical relation to said first insert, as depicted in FIGS. 5 and 6, the side walls of said first and second inserts collectively form a solid wall, As is clear from FIG. 6, said collective solid wall abuts the entire vertical extent of a beverage can 31 placed into juxtaposition with a preselected pair of vertically aligned concavities, thereby maximizing heat transfer between said inserts and the beverage within can 31. The cooler within which the inserts 10 and cans 31 are positioned is denoted 32.

Although the engagement means 24 and 26 are depicted as longitudinally spaced apart upstanding posts and cooperatively spaced recesses, respectively, the invention is not limited to such engagement means because any equivalent mechanical engagement means such as snaps and buckles, hook and loop fasteners, and the like, are clearly within the scope of this invention.

A single insert 10 may be used alone to cool beverage within a beverage container. As depicted in FIG. 7, a beverage in a beverage container 34 of preselected vertical extent is cooled when an insert 10 is immersed therewithin. The insert has a longitudinal extent substantially equal to the vertical extent of container 34 and is placed on its end as depicted. Note that end walls 20 and 22 are essentially square in shape and small so that there is ample clearance between said end walls and the circular opening of the container for the placement of a straw or straws into said container. Ample clearance between such end walls and the circular opening 35 of the beverage container 34 is also provided to facilitate grasping of the novel insert so that it can be manually removed from or introduced into container 34.

Due to the easy interlockability of the novel inserts, it is a simple matter to configure them into their stacked configuration and position them within a cooler 32 as depicted in FIGS. 5 and 6 or to use one of them alone in a container 34 for a beverage as depicted in FIGS. 7 and 8.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A device for keeping beverages cool, comprising:

a first insert of hollow, elongate construction having a longitudinal extent substantially equal to a longitudinal extent of a multi-pack beverage container;

said first insert having a flat top wall, a flat bottom wall, a pair of side walls, and a pair of flat end walls;

a first engagement means formed in said top wall;

a second engagement means formed in said bottom wall;

said first and second engagement means having a preselected complementary structure so that said first and second engagement means engage one another when the flat top wall of said first insert is disposed in underlying relation to a flat bottom wall of a second insert of similar construction and when the flat bottom wall of said first insert is placed into overlying relation to a flat top wall of said second insert;

both of said sidewalls having a plurality of concavities formed therein, each concavity adapted to receive a cylindrical surface of a beverage can;

said side walls and said end walls having a common height so that when said first and second inserts are stacked in vertical relation to one another, said side walls collectively form a solid wall so that a beverage can abutting said side walls is contacted by said side walls along its entire vertical extent;

whereby a beverage in said beverage can is efficiently cooled; and whereby a single insert is insertable into a beverage container and immersable in a beverage contained within said beverage container when said first and second inserts are in unengaged relation to one another.

2. The device of claim 1, wherein said engagement means is a pair of longitudinally spaced apart upstanding posts formed in respective top walls of said first and second inserts and a pair of post-receiving recesses formed in respective bottom walls of said first and second inserts in cooperative alignment with said posts.

3. The device of claim 1, wherein said first and second inserts are filled with a freezeable material.

4. A device for keeping a beverage cool, comprising:

an insert of hollow, elongate construction having a longitudinal extent substantially equal to a vertical extent of a beverage container;

said insert having a flat top wall, a flat bottom wall, a pair of side walls, and a pair of flat end walls;

a first engagement means formed in said top wall;

a second engagement means formed in said bottom wall;

said first and second engagement means having a preselected complementary structure;

both of said sidewalls having a plurality of concavities formed therein;

said insert standing on a preselected end wall thereof when inserted into said beverage container; and said end walls of said insert being of substantially square construction so that when said insert is immersed within a liquid contained within said beverage container, there is ample room between said end walls and a circular opening of said beverage container to admit at least one straw into said beverage container and to permit grasping of said insert to facilitate insertion and withdrawal of said insert into and from said beverage container.

* * * * *